US009814950B2

(12) United States Patent
Lytle

(10) Patent No.: US 9,814,950 B2
(45) Date of Patent: Nov. 14, 2017

(54) BALANCED SET OF IRON TYPE GOLF CLUBS

(71) Applicant: Michael F. Lytle, Phoenix, AZ (US)

(72) Inventor: Michael F. Lytle, Phoenix, AZ (US)

(73) Assignee: LYTLE RESEARCH AND DEVELOPMENT CORPORATION, Phoenix, AZ (US)

( * ) Notice: Subject to any disclaimer, the term of this patent is extended or adjusted under 35 U.S.C. 154(b) by 0 days.

(21) Appl. No.: 15/049,035

(22) Filed: Feb. 20, 2016

(65) Prior Publication Data

US 2017/0173409 A1 Jun. 22, 2017

(51) Int. Cl.
*A63B 53/00* (2015.01)
*A63B 53/04* (2015.01)

(52) U.S. Cl.
CPC ..... *A63B 53/047* (2013.01); *A63B 2053/005* (2013.01)

(58) Field of Classification Search
CPC ..... A63B 53/047; A63B 2053/005
See application file for complete search history.

(56) References Cited

U.S. PATENT DOCUMENTS 3,984,103 A * 10/1976 Nix ..... A63B 53/00 473/291
4,280,700 A * 7/1981 Plagenhoef ..... A63B 53/00 473/289
4,679,791 A * 7/1987 Hull ..... A63B 53/00 473/201
4,784,390 A * 11/1988 Horgen ..... A63B 53/00 434/252
4,811,950 A * 3/1989 Kobayashi ..... A63B 53/04 473/335
4,971,321 A * 11/1990 Davis ..... A63B 53/00 473/287
5,121,918 A * 6/1992 Teramoto ..... A63B 53/00 473/290
5,228,688 A * 7/1993 Davis ..... A63B 53/00 473/290
5,333,859 A * 8/1994 Teramoto ..... A63B 53/00 473/290
5,501,460 A * 3/1996 Scheie ..... A63B 53/04 473/290
5,595,547 A * 1/1997 Lekavich ..... A63B 53/00 473/287
5,616,086 A * 4/1997 Chappell ..... A63B 53/02 473/287
5,885,166 A * 3/1999 Shiraishi ..... A63B 53/00 473/291

(Continued)

FOREIGN PATENT DOCUMENTS

JP 2001-198243 * 7/2001

*Primary Examiner* — Stephen Blau
(74) *Attorney, Agent, or Firm* — Nicholas J. Aquilino

(57) ABSTRACT

A set of golf clubs with a plurality of at least two combinations of different lengths of a minimum of three golf clubs in each combination having progressive lofts that are matched to provide identical swing characteristics requiring unique loft and club length progressions to provide consistent yardage spacing between irons within a combination and between combinations. Each club in a combination is further defined by the shaft having an equal length; an identical swing weight, an identical grip weight and an identical head weight.

5 Claims, 5 Drawing Sheets

(56) References Cited

U.S. PATENT DOCUMENTS

| | | | | |
|---|---|---|---|---|
| 6,719,641 | B2 * | 4/2004 | Dabbs | A63B 53/04 473/291 |
| 7,235,023 | B2 * | 6/2007 | Sugimoto | A63B 53/047 473/291 |
| 8,070,621 | B2 * | 12/2011 | Nakano | A63B 53/0466 473/290 |
| 8,187,115 | B2 * | 5/2012 | Bennett | A63B 53/0466 473/290 |
| 2016/0346643 | A1 * | 12/2016 | Akiyama | A63B 53/0466 |

* cited by examiner

BALANCED SET OF IRON TYPE GOLF CLUBS

RELATED APPLICATIONS

The present application is a continuation of U.S. patent application Ser. No. 14/095,326 filed Dec. 13, 2013 titled Balanced Set of Iron Type Golf Clubs.

BACKGROUND OF THE INVENTION

The present invention relates to iron type golf clubs and in particular to a balanced set of golf clubs.

The game of golf is played by a wide variety of different players having different physical and golf swing characteristics. Because of these differences traditionally conventional sets of golf clubs are balanced using a number of variables in order to fit the particular physical and swing characteristics of particular golfers. Such variables include things such as length of the club, the weight of the club, the flexibility of the shaft, the shape and size of the club head, the swing weight of the club and the location of the center of gravity using various weighting techniques.

All of these variables relate to the "feel" of the golf club as it is used to execute a golf swing to hit a golf ball to an intended target. Once the physical size of the club, such as length and weight, is determined, golf clubs are normally balanced by adjusting the swing weight of each of the clubs so they are matched throughout the entire set. The swing weight is a variable that relates to the way the mass of the club head is distributed in the club and how the club feels as the club is swung while executing a golf swing. The center of gravity is a parameter not usually matched in a set of golf clubs.

In the traditional method of balancing golf clubs, each golf club has its own unique length, balance point, lie angle, loft, weight and other subtleties that make each club different and require a golfer to adjust and learn as many as eight to ten different golf swings in order to make a repeatable golf swing for each club. For example, the clubs designed to hit a ball the farthest distances are longer than the clubs designed to hit the golf ball shorter distances. A shortcoming of this design is that the longer clubs are typically harder to use to make solid contact with the golf ball, primarily because the swing path or arc is longer.

Prior art golf clubs that have the same swing weight, same mass and same length are known in the art. It is a common practice to use wedges of the same length in a set of golf clubs.

An attempt to create a balanced set of golf clubs is disclosed in U.S. Pat. No. 3,984,103 to Nix which is directed to a matched golf club set wherein all clubs in a class of either irons or woods have equal shaft length, equal lie angle, equal swing weight and equal total weight.

The Tommy Armour Company marketed a complete set of clubs that are the same size under the trade name Equalizers where each club in the set was the length of a conventional 6 iron. Single length irons have also been marketed under the trade name 1 Irons. Simpleton Golf is presently marketing a set of golf clubs formed of two combinations of clubs where each club in the combination is essentially the same except for the loft angle and loft progressions. While the merits of a single swing mechanic for an entire set appeared promising, the diverse specifications of 6 iron length for the high lofted irons and wedges and a six iron length for the longer and mid irons was found to be too difficult for most golfers to control and effectively use to hit consistent golf shots. Neither the Nix patent nor the prior art products considered the use of a set formed of a minimum of two combinations of identical clubs or providing a matched, precise location of the center of gravity for all clubs in a combination or the unique loft and club length progressions needed to produce the yardage spacing found in traditional golf club sets.

Another patent of interest is U.S. Pat. No. 5,624,329 to Schneebeli that shows matched putter and chipper golf clubs that are identical in weight, length, balance and feel.

SUMMARY OF THE INVENTION

The present invention relates to a set of golf clubs having a plurality a minimum of two separate combinations, preferably three combinations. Each combination includes individual clubs that are the same length in a particular combination but are a different length than the lengths of the clubs of the other combinations. The difference in club length between combinations is constant and is repeated between the various combinations.

Each combination has at least three or more golf clubs of the same length and varying lofts designed to hit a golf ball different distances. The higher lofted clubs are designed to hit a golf ball a shorter distance than the lower lofted clubs, requiring unique loft and club length progressions to provide consistent yardage spacing within and between the irons within and between combinations. This approach in golf club set design is somewhat similar to the traditional progression of lengths within a set of conventional design but differs in that the irons of the present invention are separated into combinations requiring a majority of golfers to learn no more than three swing parameters as opposed to the 8 to 10 different swings required by a traditional set of irons.

In addition, the difference in length of the clubs in one combination as compared to another adjoining combination is the same for all combinations. For example, in the embodiment disclosed, the difference in length of the clubs between the first and second combination is the same as the difference in length of the clubs between the second and third combination.

Each club in a combination is matched to provide identical swing characteristics. The entire set is provided with unique loft progressions between the clubs in the combinations, whereby each of the combinations is formed with the same loft difference between the individual clubs in any particular combination. That is the difference in loft between all clubs in a single combination is the same number of degrees. In addition, each separate combination has a loft difference between the individual clubs in that combination that is different from the loft difference of the individual clubs in any of the other combinations.

Another feature of the set of golf clubs of the present invention is that the loft difference between the highest lofted club in a combination and the lowest lofted club in an adjoining higher lofted combination is no more than the loft difference between consecutive individual clubs in the prior less lofted combination and is less than the loft difference between consecutive individual clubs in an adjoining higher lofted combination.

The present set of golf clubs has a loft difference between the highest lofted club in a combination and the lowest lofted club in an adjoining higher lofted combination that is less than the loft difference between the highest lofted club in the same adjoining higher lofted combination and the lowest lofted club in the next adjoining higher lofted combination.

In addition, the clubs include a shaft and a grip at the upper end of said shaft and each of the clubs in the combination has the same length, swing weight and club head weight while maintaining a consistent center of gravity. The center of gravity is defined by the intersection of the horizontal (X), vertical (Y) and anterior/posterior (Z) axis often referred to as the actual center of gravity and is located equidistant from the ball striking face.

Each individual golf club of the combination of golf clubs in accordance with the present invention is made within the following tolerances while maintaining essentially identical characteristics. The designated loft of each individual club may vary plus or minus 1.0 degrees. The designated length may vary plus or minus 0.275 inches. The designated swing weight may vary plus or minus 1.0 swing weight points or 50 gram inches. The designated club head weight may vary plus or minus 5.0 grams. The resultant center of gravity may vary plus or minus 0.125 inches from its reference point.

The range of parameters for multiple combinations of different lengths of three or more consecutive golf clubs within a set is preferably the following: the lofts of a club head defining the ball striking face are between 15 and 65 degrees; the length of a club is between 30 and 40 inches; the swing weight of a club is between 5350 gram/inches and 6350 gram/inches; the club head weight is between 220 grams and 370 grams and the vertical center of gravity is between 0.50 inches and 0.90 inches, and the horizontal center of gravity is 0.125 inches from the centerline of the ball striking face, and the anterior/posterior center of gravity is 0.125 inches from its reference point of 0.15 inches behind the striking face.

An entire set may comprise up to a maximum of 12 consecutive irons lofted from 15 degrees to 65 degrees. The golf club combinations within a particular set have a minimum of three consecutive clubs 102.

Among the objects of the present invention is a set of golf irons having at least two or more combinations of different lengths of golf clubs having the same length, same weight, same swing weight and consistent center of gravity in each of the combinations of clubs in the set.

Still another object is the provision of a set of golf clubs formed of at least two combinations of individual clubs having the same loft difference between the clubs of a same combination.

Another object is the provision of a set of golf clubs formed of multiple combinations where the difference in loft between clubs in a particular combination is different than the difference in loft between clubs in other combinations.

A further object is the provision of a set of golf clubs formed of at least two combinations wherein the loft difference between individual clubs in a first combination is greater than the clubs of another combination when the length of the clubs in the first combination is less than the length of the clubs of another combination.

Another object of the present invention is the provision of a combination of at least three individual golf clubs having the same center of gravity by adjustment of the physical size and shape of the club head.

These and other objects will become apparent with reference to the drawings and specification of the present application.

DESCRIPTION OF THE PREFERRED EMBODIMENTS OF THE INVENTION

Figure 1:
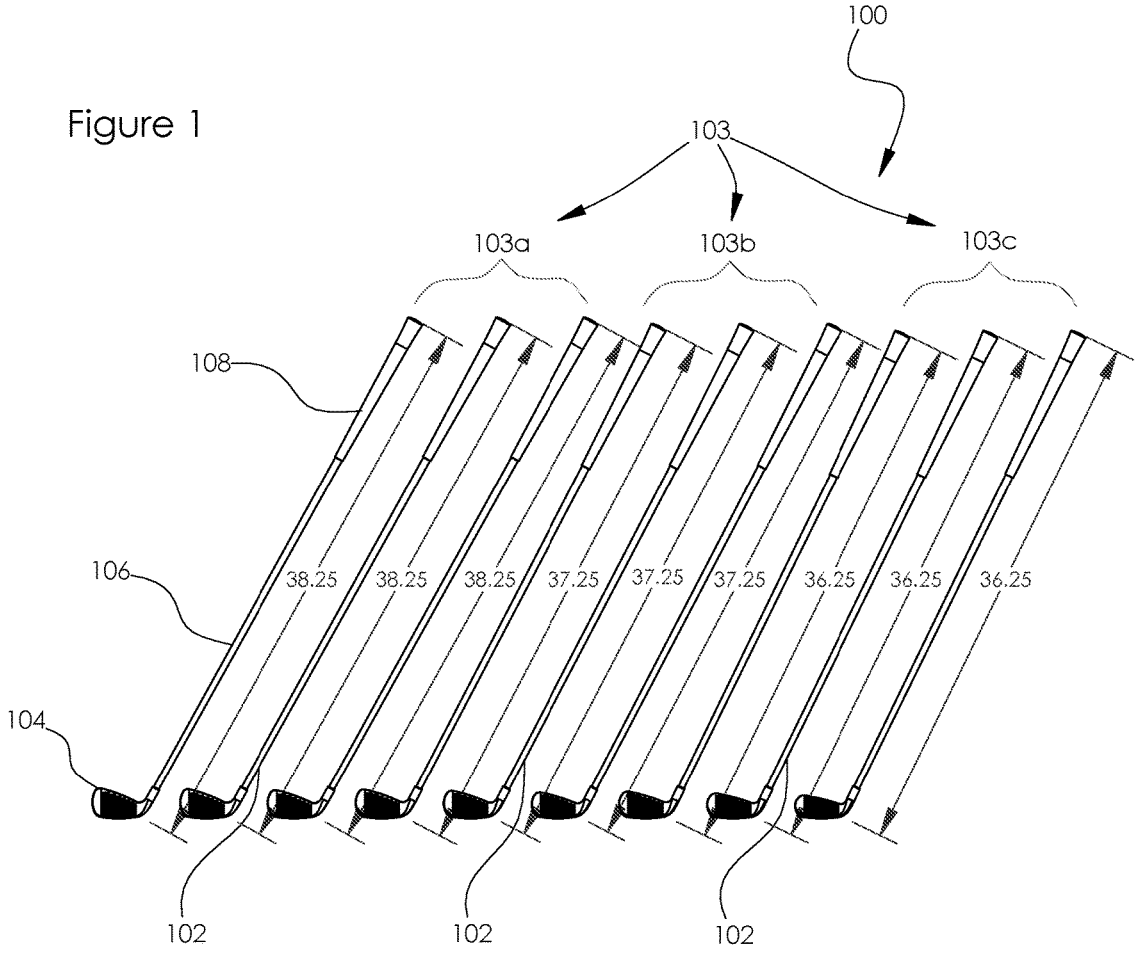
FIG. 1 is an elevational view of a set of golf club irons made in three combinations of three clubs in accordance with present invention.

Referring to the drawings, FIG. 1 discloses a set of golf clubs 100 in accordance with the principles of the present invention. The set includes individual clubs 102 in three adjoining combinations 103 as represented by a first combination 103*a* of a first three clubs 102, a second combination 103*b* of a middle three clubs 102 and a third combination 103*c* of a last three clubs 102. Each golf club 102 of the set includes a club head 104, shaft 106 and grip 108.

The overall length of each club 102 preferably is between 30 and 40 inches, the exact length being determined by the physical size and overall dimensions of the particular golfer who will use the clubs. In the embodiment shown, each club 102 of a first combination 103*a* of the set 100 is made the same length of 38.25 inches within a tolerance of 0.275 inches. The second combination 103*b* of three clubs 102 has a length of 37.25 inches also within a tolerance of 0.275 inches. The third combination 103*c* of three clubs has a length of 36.25 with a 0.275 inch tolerance.

In the present embodiment, the first combination 103*a* has a length of 38.25 inches plus or minus 0.275 inches. The adjoining combination 103*b* has a length of 37.25 inches plus or minus 0.275 inches. The difference in length of the clubs in these combinations 103*a* and 103*b* as disclosed is 1 inch and may be as little as 0.45 inches and as great as 1.55 inches in keeping within the above parameters. The length of the clubs 102 in the third adjoining combination 103*c* is 36.25 inches plus or minus 0.275 inches. As with the first two combinations 103*a* and 103*b*, the difference in length of the clubs of combination 103*c* and the clubs 102 of the previously adjoining combination 103*b* is also disclosed as 1 inch and may be as little as 0.45 inches and as great as 1.55 inches. Embodiments of a set of golf clubs using more than three combinations to make the set will maintain the same difference in length of 0.45 inches to 1.55 inches for all adjoining combinations.

Each club 102 in a combination 103*a*, for example, is matched to provide identical swing characteristics and the set 100 is provided with unique loft progressions between the clubs in the combinations. The individual clubs 102 in any of the combinations are formed with a loft difference between the individual clubs 102 in any particular combination that is the same. For example, the clubs 102 in the first combination 103*a* all have a loft difference of 3.0 degrees between the clubs 102. The clubs 102 in the second combination have a loft difference 3.5 degrees and the clubs 102 in the third combination have a loft difference of 4.0 degrees. Therefore, each separate combination 103*a*, 103*b* and 103*c* has a loft difference between the individual clubs in that combination that is different from the loft difference of the individual clubs in any of the other combinations.

Another feature of the set 100 of golf clubs 102 of the present invention is that individual combinations of clubs have progressively greater loft differences between individual clubs as the length of the clubs 102 in individual combinations decrease. In other words, the higher lofted clubs 102 in a combination have a greater difference in loft between the clubs. For example, combination 103*c* has individual clubs 102 that have the shortest length of 36.25 inches and have a loft difference of 4 degrees between the individual clubs 102 in that combination 103*c*. Likewise combination 103*b* that has a length of 37.25 inches for each individual club 102 has a lesser loft difference of 3.5 degrees between the individual clubs 102. Combination 103*a* that has the longest length of 38.5 inches for each club 102, has the least loft difference of 3.0 degrees between the individual clubs 102 in the combination 103*a*.

The swing weight of each club 102 in any of the individual combinations 103 of clubs is essentially the same and may vary plus or minus 1.0 swing weight points or 50 gram inches and may vary between combinations. Overall the swing weight is between 5350 gram/inches and 6350 gram/inches depending upon the physical characteristics and the individual swing of the golfer using the set of clubs 100.

includes a ball striking face 110, heel 112, toe 114, top ridge 116, bottom sole 118, and a rear peripheral weight 120, having a rear face 122, formed at an angle between said striking face 110 and rear face 122, the angle progressively increasing in a heel 112 to toe 114 direction. A rear cavity 124 is formed in the rear weight 120. The club head 104 further includes a hosel 126 for connection to a shaft 106 as shown in FIG. 1.

Each club head 104 is made as a single integral unit with all the club head parameters as described above precisely controlled using conventional forging, casting, CNC milling, 3D printing or other manufacturing techniques.

The set includes at least two combinations 103 formed of a plurality of at least three golf clubs 102, with progressively increasing lofts, each having a club head 104, a shaft 106 and grip 108 to provide identical swing characteristics when using essentially the same golf swing.

Table 1 discloses typical measurements of various parameters of three combinations 103 of golf clubs 102 the make up a set 100. The table quantifies the center of gravity, CG, the toe and heel heights, the club head weight, the grip weight, the shaft weight, the shaft length, the total length, the cavity parameters, the back angle and the back height of the club head.

TABLE 1

| | | 20.5 | 23.5 | 26.5 | 29.5 | 33 | 36.5 | 40 | 44 | 48 |
|---|---|---|---|---|---|---|---|---|---|---|
| CG X-axis | Inches | 0.05 | 0.05 | 0.04 | 0.04 | 0.04 | 0.03 | 0.05 | 0.05 | 0.05 |
| CG Y Axis | Inches | 0.71 | 0.72 | 0.72 | 0.70 | 0.70 | 0.69 | 0.67 | 0.66 | 0.64 |
| CG Z Axis | Inches | −0.19 | −0.17 | −0.17 | −0.16 | −0.15 | −0.14 | −0.13 | −0.12 | −0.11 |
| Head Weight | grams | 252.0 | 252.0 | 252.0 | 268.0 | 268.0 | 268.0 | 285.0 | 285.0 | 285.0 |
| Grip Weight | grams | 50.00 | 50.00 | 50.00 | 50.00 | 50.00 | 50.00 | 50.00 | 50.00 | 50.00 |
| Shaft Weight | grams | 125.0 | 125.0 | 125.0 | 121.0 | 121.0 | 121.0 | 117.0 | 117.0 | 117.0 |
| Shaft Length | inches | 37.07 | 37.07 | 37.07 | 36.07 | 36.07 | 36.07 | 35.07 | 35.07 | 35.07 |
| Total Length | inches | 38.25 | 38.25 | 38.25 | 37.25 | 37.25 | 37.25 | 36.25 | 36.25 | 36.25 |
| Major Tran Axis (MATA) | Inches | 2.48 | 2.48 | 2.48 | 2.48 | 2.48 | 2.48 | 2.48 | 2.48 | 2.48 |
| Minor Tran Axis (MITA) | Inches | 0.55 | 0.55 | 0.55 | 0.55 | 0.55 | 0.55 | 0.55 | 0.55 | 0.55 |
| Cavity Area | Sq In | 1.07 | 1.07 | 1.07 | 1.07 | 1.07 | 1.07 | 1.07 | 1.07 | 1.07 |
| Back Angle | degrees | 6.25 | 6.25 | 6.25 | 6.25 | 6.25 | 6.25 | 6.25 | 6.25 | 6.25 |
| Back Height | Inches | 0.61 | 0.61 | 0.60 | 0.56 | 0.55 | 0.54 | 0.50 | 0.49 | 0.48 |
| Toe Height | Inches | 2.01 | 2.01 | 2.01 | 2.13 | 2.13 | 2.13 | 2.44 | 2.44 | 2.44 |
| Heel Height | Inches | 1.06 | 1.06 | 1.06 | 1.18 | 1.18 | 1.18 | 1.30 | 1.30 | 1.30 |

The club head weight is the same for each club 102 of any of the individual combinations 103 of the set 100 and overall is between 220 grams and 370 grams and may vary plus or minus 5.0 grams.

The center of gravity, CG, is also essentially the same for each club 102 in a given combination 103 of the set. The Y-axis is located 0.50 inches to 0.90 inches from the bottom of the club head. The X-axis is located at the centerline of the club face. The Z-axis is located 0.15 inches posterior to the club face. The X, Y and Z axes may vary plus or minus 0.125 inches from its reference point. The CG is located at a point equidistant from the ball striking face for all clubs in a combination.

Figure 2:
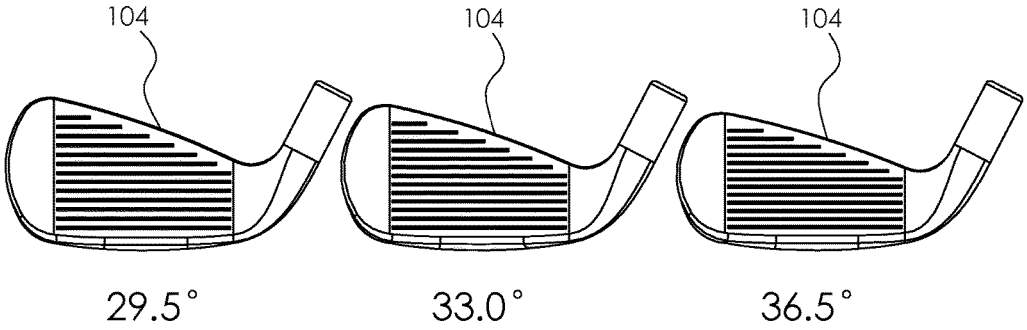
FIG. 2 is an elevational view of three iron type, golf club heads forming a single combination of clubs of the present invention.
Figure 3:
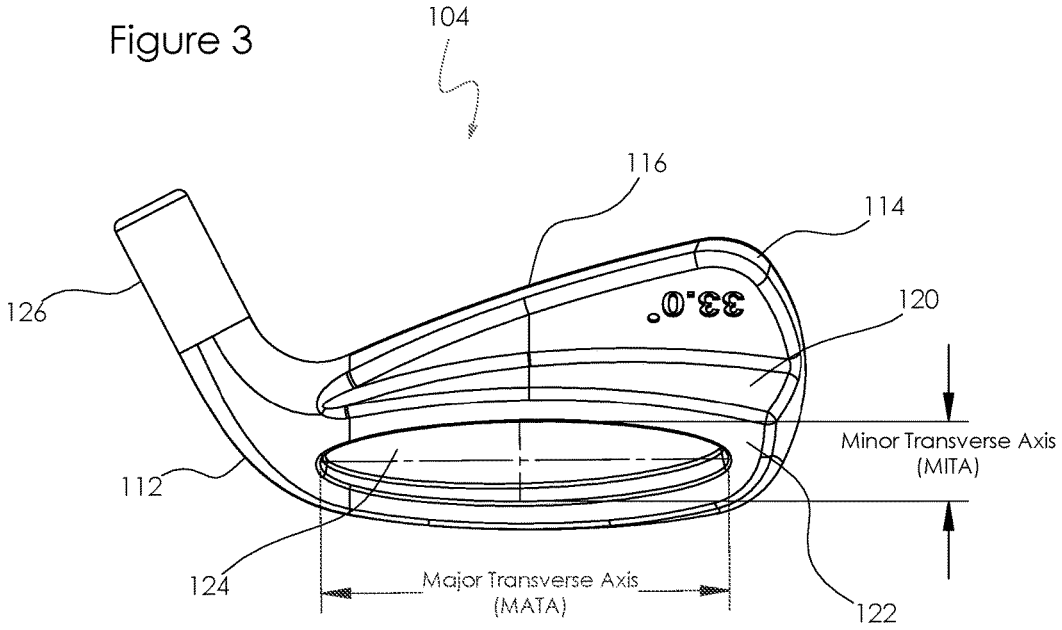
FIG. 3 is a rear elevational view of a single iron type golf club head of the invention.
Figure 4:
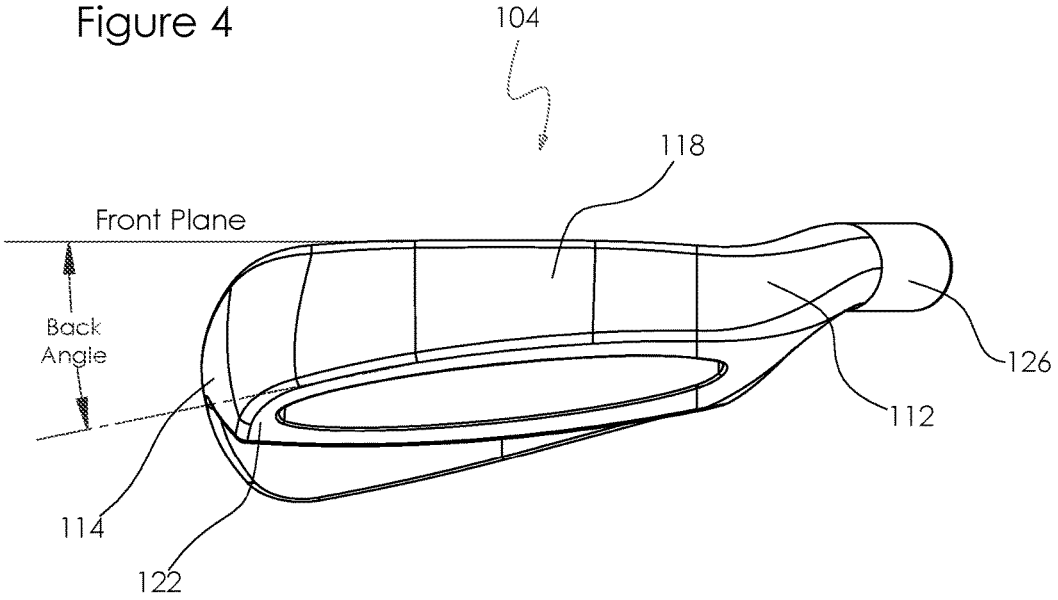
FIG. 4 is a bottom view of the club head of FIG. 3.
Figure 5:
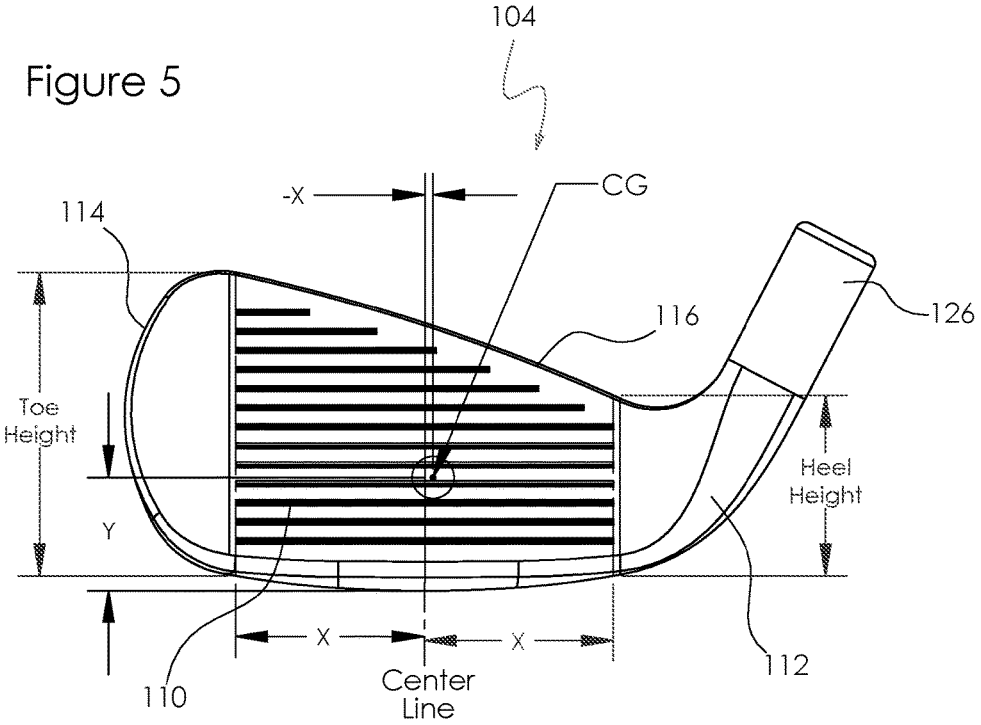
FIG. 5 is a front elevational view of the club head of FIG. 3.
Figure 6:
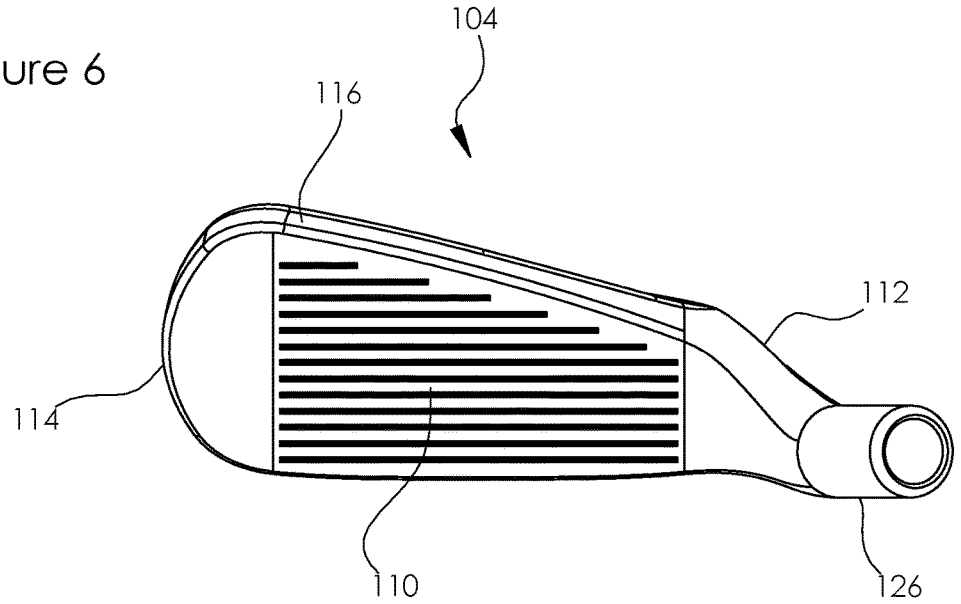
FIG. 6 is a top plan view of the club head of FIG. 3.
Figure 7:
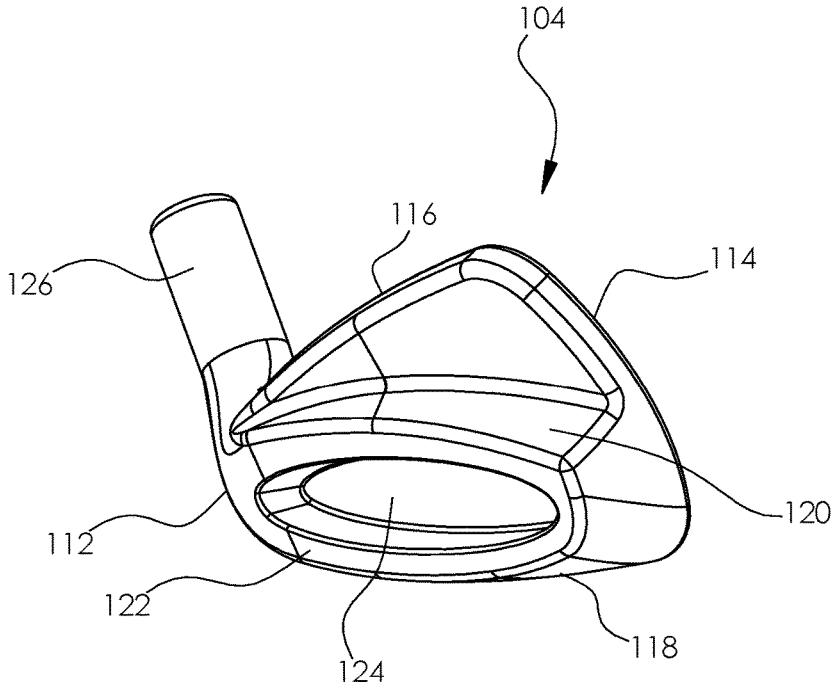
FIG. 7 is a toe perspective view of the club head of FIG. 3.
Figure 8:
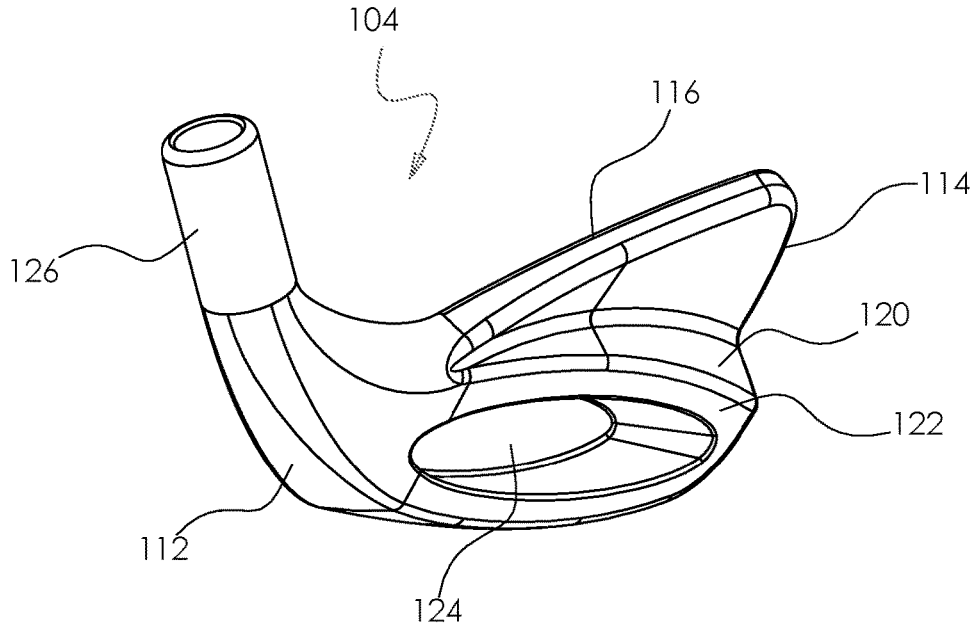
FIG. 8 is a heel perspective view of the club head of FIG. 3.
Figure 9:
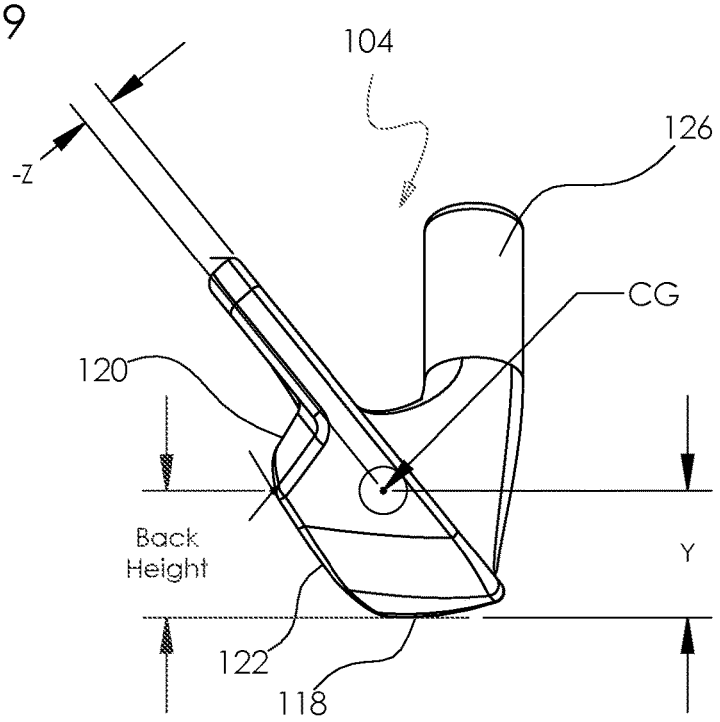
FIG. 9 is a toe end view of the club head of FIG. 3.

FIG. 2 shows three club heads 104 of a typical combination 103 having different lofts of 29.5 degrees, 33.0 degrees and 36.5 degrees but with identical physical characteristics as described below.

FIGS. 3 through 8 show a typical club head 104 of a generally conventional design used in the golf set 100 of the present invention. It will be appreciated that all club heads 104 within the set 100 vary primarily in loft angle throughout the set 100 in a conventional manner. Each club head 104

The present invention is not limited to the specific golf club heads disclosed and it is equally applicable to club heads of various designs and shapes. It will also be appreciated that other modifications, including but not limited to the preferred embodiment, can be made to the combinations of golf clubs disclosed above in keeping within the spirit and scope of the invention as described in the following claims.

The invention claimed is:

1. A set of a golf clubs having a plurality of at least two combinations of clubs; each combination of said set having a different length than the length of other combinations of said set; the difference in club length between combinations being constant and repeated between all combinations in a set; the club length difference between successive combinations of clubs is no less than 0.45 inches and no more than 1.55 inches; each combination including a minimum of three golf clubs; each of the minimum of three golf clubs in a combination having the same length are matched to provide identical swing characteristics; said combinations of said set having unique loft progressions between the clubs in the individual combinations, whereby each of the combinations is characterized by a loft difference between the individual clubs in any particular combination that is the same; and each combination having a loft difference between the individual clubs in that combination that is different from the loft difference of the individual clubs in any of the other combinations; each individual combination of clubs has progressively greater loft differences between individual clubs as the length of the clubs in the individual combinations decrease; each club being further defined by an identical club head weight; and, each club having an identical swing weight.

2. The set of claim 1 wherein the loft difference between the highest lofted club in a combination and the lowest lofted club in an adjoining, higher lofted combination is less than the loft difference between the highest lofted club in the same ad joining, higher lofted combination and the lowest lofted club in the next adjoining, higher lofted combination.

3. The set of claim 2 wherein the loft difference between the highest lofted club in a combination and the lowest lofted club in an adjoining, higher lofted combination is no more than the loft difference between consecutive individual clubs in the prior less lofted combination and is less than the loft difference between consecutive individual clubs in an adjoining, higher lofted combination.

4. The set of claim 1 wherein each individual golf club includes a club head formed of a ball striking face, upper surface, bottom, toe, heel and rear surface including an integral rear weight; each individual golf club including a shaft and a grip at the upper end of said shaft.

5. The set of claim 1 further defined by the height of said toe and the height of said heel in individual irons is the same for each individual club within each combination.

* * * * *